United States Patent [19]

Marjollet et al.

[11] Patent Number: 5,042,432

[45] Date of Patent: Aug. 27, 1991

[54] SUPERHEAT BUNDLE FOR A HORIZONTAL TUBE STEAM SEPARATOR-SUPERHEATER

[75] Inventors: Jacques Marjollet, Paris; Jean-Jacques Marsault, Saint Arnoult en-Yvelines, both of France

[73] Assignee: Stein Industrie, Velizy-Villacoublay, France

[21] Appl. No.: 465,662

[22] Filed: Jan. 16, 1990

[30] Foreign Application Priority Data

Jan. 19, 1989 [FR] France ..... 89 00595

[51] Int. Cl.[5] ..... F22G 1/00

[52] U.S. Cl. ..... 122/483; 55/462; 122/488

[58] Field of Search ..... 122/483, 488, 491; 55/462, 463, 465

[56] References Cited

U.S. PATENT DOCUMENTS 1,803,035 4/1931 Potter .
3,745,978 7/1973 Armand ..... 122/483
4,671,214 6/1987 Alias et al. ..... 122/483 X
4,714,054 12/1987 Minard et al. ..... 122/488 X
4,717,400 1/1988 Ozeki et al. ..... 122/483 X
4,759,555 7/1988 Halling ..... 277/200

FOREIGN PATENT DOCUMENTS 2485144 12/1981 France .

*Primary Examiner*—Edward G. Favors
*Attorney, Agent, or Firm*—Sughrue, Mion, Zinn, Macpeak & Seas

[57] ABSTRACT

A superheat bundle for a horizontal tube steam separator-superheater, in which the tubes are disposed inside a rectangular frame (4) which is not rigidly connected to the structure of the separator-superheater. The frame is provided with resilient blades (7, 8) forming a flexible skirt bearing against side plates (2, 3) which are themselves rigidly connected to said structure. The invention is applicable to stations for producing electricity or steam.

4 Claims, 2 Drawing Sheets

SUPERHEAT BUNDLE FOR A HORIZONTAL TUBE STEAM SEPARATOR-SUPERHEATER

The present invention relates to a superheat bundle for a horizontal tube steam separator-superheater with its tubes disposed inside a rectangular frame.

BACKGROUND OF THE INVENTION

Stein Industrie's European patent specification EP-A-0 005 225 describes a steam separator-superheater of this type having a horizontal axis and comprising, above separators for separating out the water entrained by the steam, rectangular bundles of tubes for superheating said steam by exchanging heat with steam at a higher pressure. These bundles are held in frames rigidly connected to beams extending transversely to the axis of the separator-superheater They do not provide perfect sealing to prevent steam getting round the bundle of tubes by flowing along the sides of the frame. They are capable of being installed in the separator-superheater only on site, e.g. by causing them to run along rails fixed to the bottom portion of the rigid frame.

The object of the present invention is to provide superheat bundles providing excellent sealing against steam getting round the sides of the frame, and also capable of being factory mounted in the separator-superheater.

SUMMARY OF THE INVENTION

In the superheat bundle of the invention the rectangular frame is not rigidly connected to the structure of the separator-superheater, and it is provided with resilient blades forming a flexible skirt bearing against side plates which are themselves rigidly connected to said structure.

Preferably, the resilient blades are generally L-shaped, being fixed at the end of a short side to each margin of the top portion of the frame which is not rigidly connected to the structure, and bearing via their long sides against the side plates which are rigidly connected to the structure.

Advantageously, the superheat bundle includes two superposed resilient blades along each of its margins between the frame which is not rigidly connected to the structure and the side plates which are rigidly connected to the structure.

BRIEF DESCRIPTION OF THE DRAWINGS

An embodiment of the invention is described by way of example with reference to the accompanying drawings, in which.

DETAILED DESCRIPTION

Figure 1:
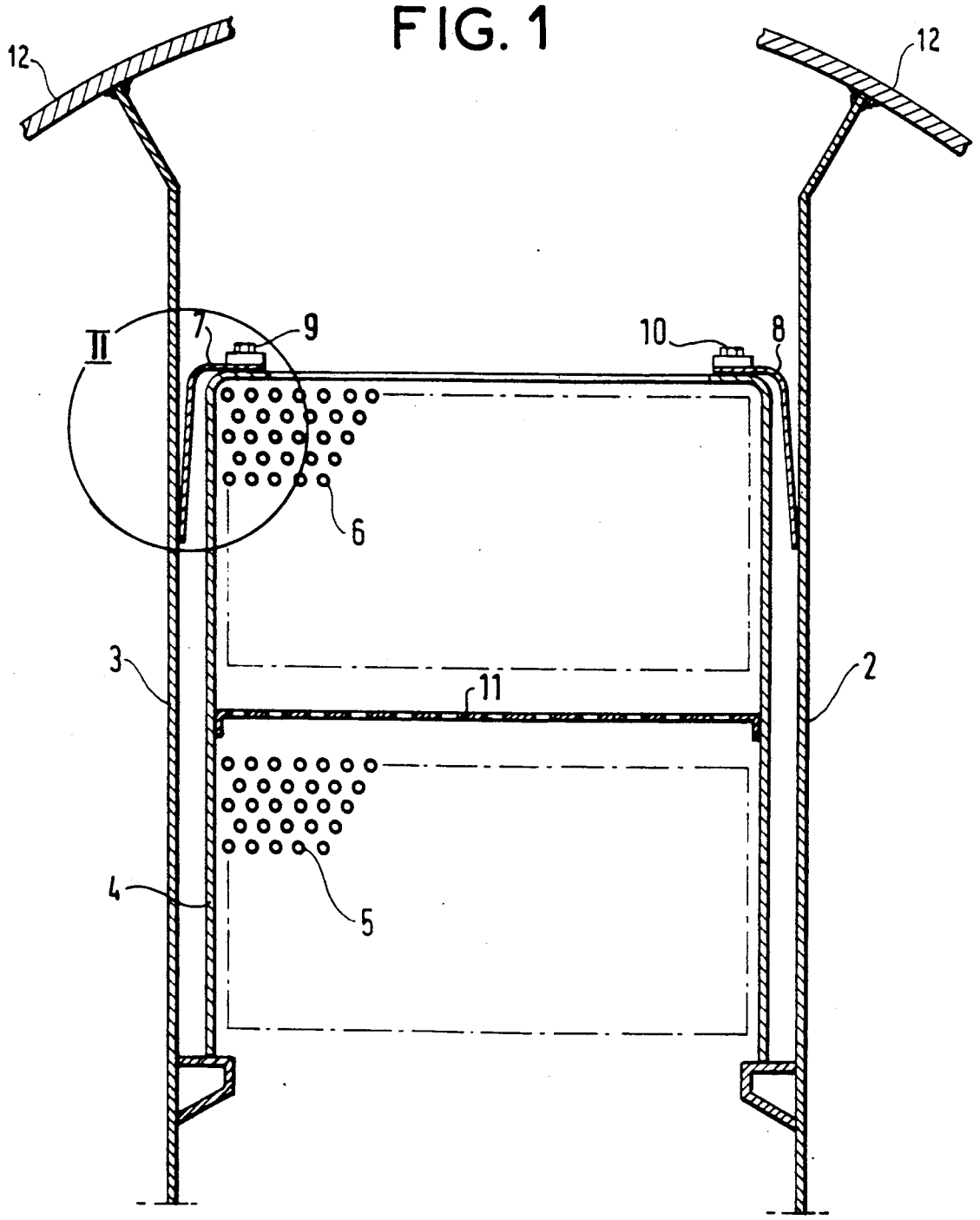
FIG. 1 is a section through a bundle on a plane perpendicular to its axis.

An assembly of superheat tube bundles 5 and 6 constituted by tubes disposed in triangular lattices, is contained in a rectangular frame 4 which is itself held inside a rigid frame constituted by side plate 2 and 3 which, are rigidly connected to a cylindrical external cylinder structure 12. The bundles 5 and 6 are constituted, for example, by hairpin-bend tubes connected to tube plates both situated on the same side of the plane of the figure. The bundles 5 and 6 are separated from each other by a plate 11 which is perforated with steam-passing holes.

The inner frame 4 is resiliently connected to the outer frame 2, 3 which is rigidly connected to the outer shell by means of flexible L-shaped blades 7, 8 constituting a flexible skirt, with the short sides of the L-shapes being bolted at 9, 10 to the top of the frame 4 and with the long sides thereof bearing against the inside faces of the plates 2 and 3.

These blades provide sealing between the frame 4 and respective ones of the plates 2 and 3, thereby allowing the frame 4 to expand and contract relative thereto.

Figure 2:
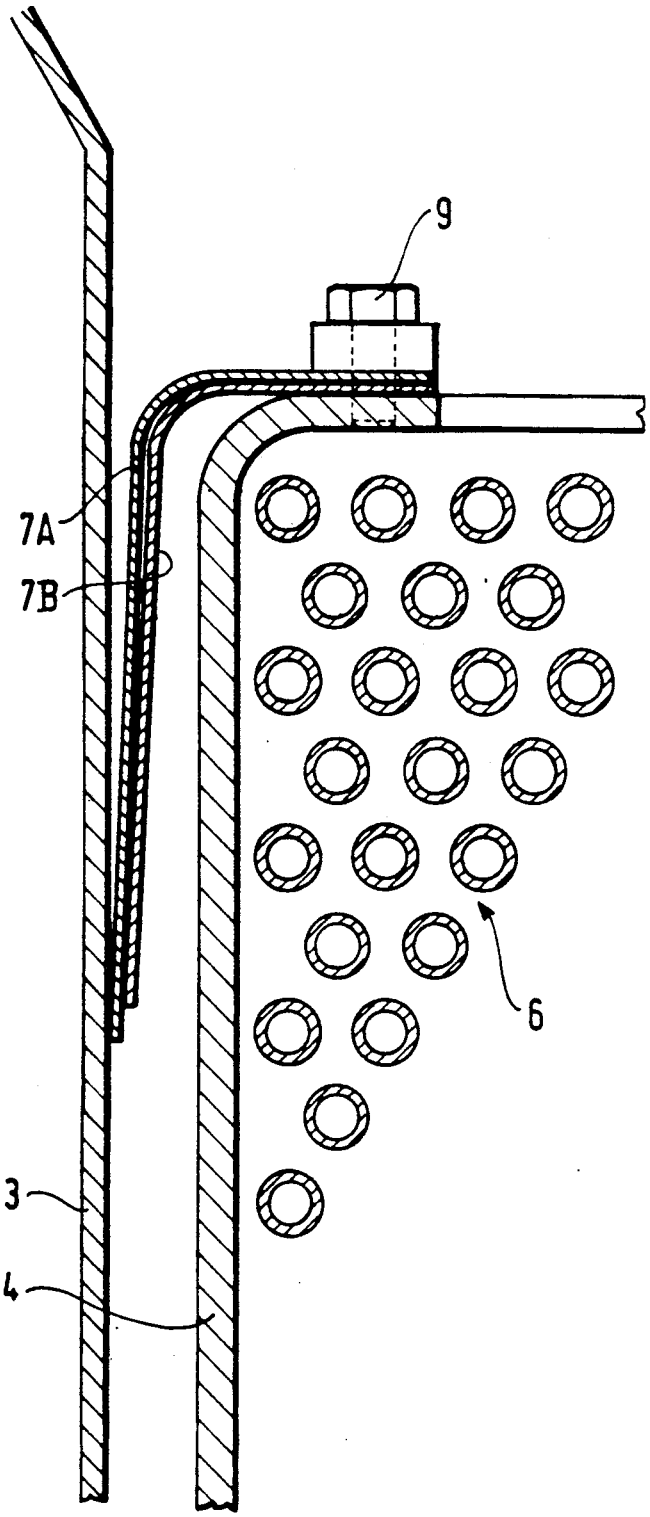
FIG. 2 shows a detail II of FIG. 1 on a larger scale, said detail being constituted by resilient blades forming a connection skirt between the inner frame and the outer frame which is rigidly connected to the structure.

As shown in FIG. 2, each side of the sealing skirt is preferably constituted by two blades 7A and 7B bolted together (e.g. at 9) to the top portion of the frame 4 with the short side of the inner blade 7B being shorter than that of the outer blade 7A, thereby enabling the long side of the inner blade 7B to bear against the inside face of the outer blade.

We claim:

1. A superheat bundle for a horizontal tube steam separator-superheater, in which the tubes are disposed inside a rectangular inner frame wherein the rectangular inner frame is not rigidly connected to the structure of the separator-superheater, and is provided with resilient blades fixed solidly to said inner frame forming a flexible skirt resiliently bearing against side plates of an outer frame rigidly connected to said structure and supporting said inner frame.

2. A superheat bundle according to claim 1, wherein the resilient blades are generally L-shaped, being fixed at the end of a short side to each margin of a top portion of the inner frame which is not rigidly connected to the structure, and bearing resiliently via long sides thereof against said outer frame side plates which are rigidly connected to the structure.

3. A superheat bundle according to claim 2, wherein said resilient blades are constituted by two superposed resilient blades along each of tis margins between the inner frame which is not rigidly connected to the structure and the outer frame side plates which are rigidly connected to the structure.

4. A superheat bundle according to claim 1, wherein said resilient blades are constituted by two superposed resilient blades along each of tis margins between the inner frame which is not rigidly connected to the structure and the outer frame side plates which are rigidly connected to the structure.

* * * * *